US010780445B2

(12) United States Patent
Mackel et al.

(10) Patent No.: US 10,780,445 B2
(45) Date of Patent: Sep. 22, 2020

(54) SEPARATOR WITH INNER AND OUTER DRUM AND ONE OR MORE GRIPPERS HAVING A DISK PORTION AND A SHANK PORTION

(71) Applicant: GEA MECHANICAL EQUIPMENT GMBH, Oelde (DE)

(72) Inventors: Wilfried Mackel, Lippetal-Herzfeld (DE); Thomas Bathelt, Oelde (DE); Kathrin Quiter, Drensteinfurt (DE); Frank Taetz, Delbrück (DE)

(73) Assignee: GEA MECHANICAL EQUIPMENT GmbH, Oelde (DE)

( * ) Notice: Subject to any disclaimer, the term of this patent is extended or adjusted under 35 U.S.C. 154(b) by 641 days.

(21) Appl. No.: 15/532,683

(22) PCT Filed: Nov. 27, 2015

(86) PCT No.: PCT/EP2015/077910
§ 371 (c)(1),
(2) Date: Jun. 2, 2017

(87) PCT Pub. No.: WO2016/091617
PCT Pub. Date: Jun. 16, 2016

(65) Prior Publication Data

US 2017/0333915 A1 Nov. 23, 2017

(30) Foreign Application Priority Data

Dec. 10, 2014 (DE) ..... 10 2014 118 289

(51) Int. Cl.
*B04B 1/08* (2006.01)
*B04B 7/08* (2006.01)
*B04B 11/02* (2006.01)

(52) U.S. Cl.
CPC ..... *B04B 1/08* (2013.01); *B04B 7/08* (2013.01); *B04B 11/02* (2013.01)

(58) Field of Classification Search
CPC .. B04B 1/08; B04B 11/02; B04B 7/08; B04B 11/00; B04B 7/00
(Continued)

(56) References Cited

U.S. PATENT DOCUMENTS 2,017,734 A 10/1935 Sandstrom
2,286,354 A 6/1942 Fitzsimmons
(Continued)

FOREIGN PATENT DOCUMENTS

DE 69321935 T2 5/1999
DE 102008052630 A1 4/2010
(Continued)

OTHER PUBLICATIONS

International Search Report dated Feb. 12, 2016 in related International Application No. PCT/EP2015/077910.
(Continued)

*Primary Examiner* — Walter D. Griffin
*Assistant Examiner* — Shuyi S. Liu
(74) *Attorney, Agent, or Firm* — Patent Portfolio Builders PLLC

(57) ABSTRACT

A separator for centrifugally processing a flowable product includes a rotatable drum bounding a centrifuging chamber. The drum has a feeding and removal system having at least one feeding device and one or more removal devices composed of plastic or a plastic composite. An inner drum, composed of plastic or a plastic composite, is arranged in an outer supporting device of the drum. The feeding device and the one or more removal devices extend into the inner drum, do not rotate with the inner drum during operation, and are glued and/or welded to each other in such a way that the
(Continued)

Figure 1A:
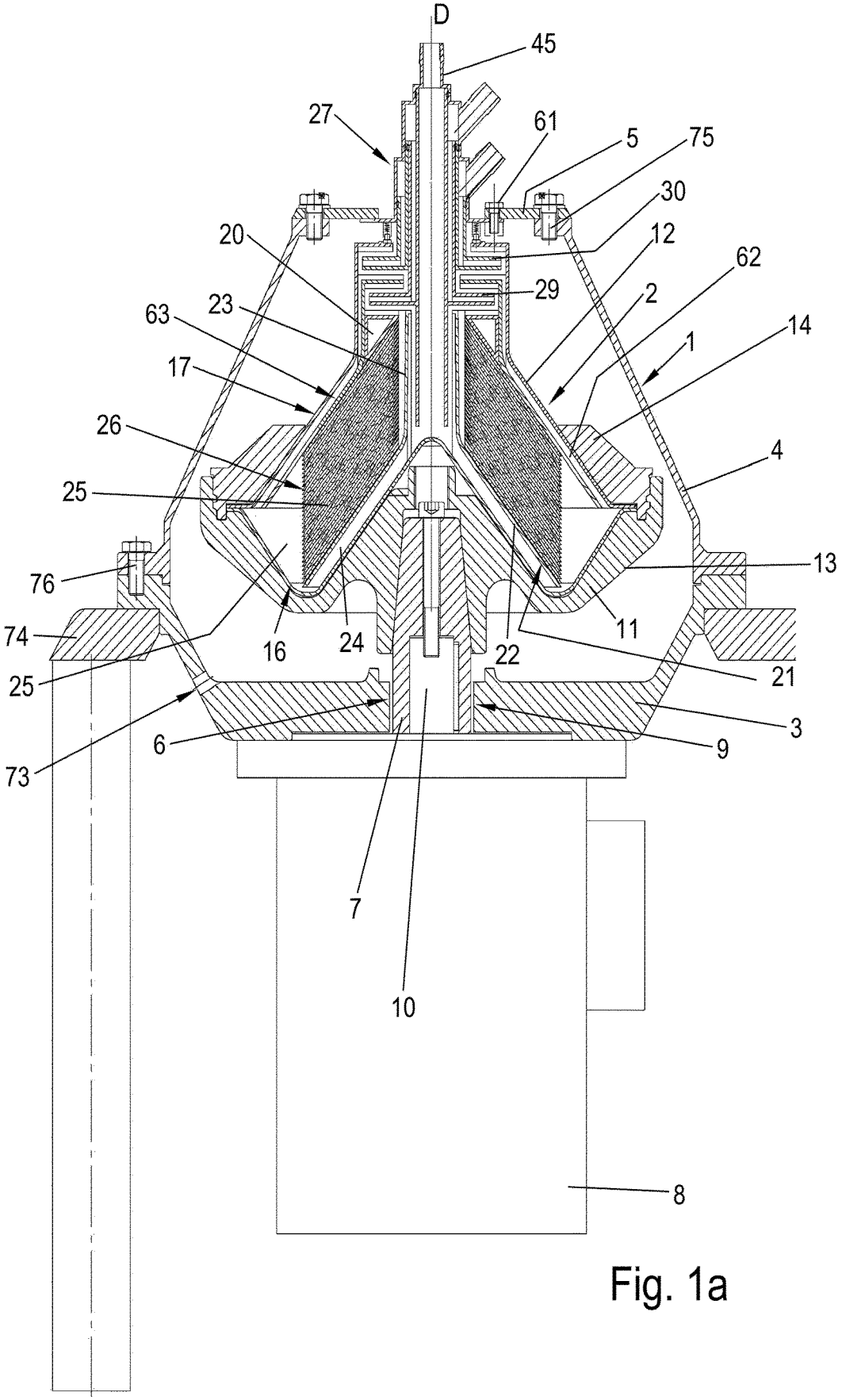

feeding device and the one or more removal devices are sealingly connected. The feeding and removal system has one or more grippers as the removal device, each of which one or two or more grippers has a disk segment and a shaft segment.

35 Claims, 3 Drawing Sheets

(58) Field of Classification Search
USPC ..... 494/37, 44, 45, 60, 67, 68, 75
See application file for complete search history.

(56) References Cited

U.S. PATENT DOCUMENTS

| | | | | |
|---|---|---|---|---|
| 3,012,710 | A * | 12/1961 | Steinacker | B04B 7/08 494/38 |
| 4,027,820 | A * | 6/1977 | Kulker | B04B 1/18 494/27 |
| 5,387,174 | A | 2/1995 | Rochat | |
| 5,637,217 | A | 6/1997 | Herman et al. | |
| 2011/0319248 | A1 | 12/2011 | Starbard | |
| 2014/0045672 | A1 * | 2/2014 | Galavotti | B04B 5/0442 494/44 |
| 2016/0184836 | A1 | 6/2016 | Mackel et al. | |

FOREIGN PATENT DOCUMENTS

| | | | | |
|---|---|---|---|---|
| JP | S62117649 | A | 5/1987 | |
| WO | WO-8601436 | A1 * | 3/1986 | B04B 11/04 |
| WO | 9840164 | | 9/1998 | |
| WO | 2014000829 | A1 | 1/2014 | |

OTHER PUBLICATIONS

Search Report created on Sep. 2, 2015 in related DE Application No. 10 2014 118 289.8.

Written Opinion dated Feb. 12, 2016 in related International Application No. PCT/EP2015/077910.

* cited by examiner

SEPARATOR WITH INNER AND OUTER DRUM AND ONE OR MORE GRIPPERS HAVING A DISK PORTION AND A SHANK PORTION

BACKGROUND AND SUMMARY OF THE INVENTION

Exemplary embodiments of the invention relate to a separator.

Centrifugal separators for realizing a continuous operation have long been known, for instance in an embodiment as nozzle separators from Japanese patent document JP 62-117649 A. Nozzle separators, those of the kind having solids discharge openings, to which is assigned a hydraulically actuable piston valve, with which the solids discharge openings can be closed off and opened up, are known. US Patent document U.S. Pat. No. 2,017,734 discloses a separator without solids discharge, in a configuration as a separator. In addition, US Patent document U.S. Pat. No. 2,286,354 discloses a separator having solid drum top parts and drum bottom parts, which have been screwed together.

Moreover, PCT International patent document WO 2014/000829 A1 discloses a separator of the generic type for separating a flowable product into different phases or for clarifying a product, which separator has a rotatable drum, having a drum bottom part and a drum top part, and a clarifying means arranged in the drum, wherein one or more or all of the following elements consist of plastic or a plastics composite: the drum bottom part, the drum top part, the clarifying means. In that way, it is possible to design a part of the drum, or preferably even the entire drum—preferably along with the inflow and outflow systems and regions—for single use, which is of interest and advantage in particular with regard to the processing of pharmaceutical products such as fermentation broths or the like, since, following operation for the processing of an appropriate product batch in the, during processing of the product batch, preferably continuous operation, no cleaning of the drum has to be performed, but rather the drum can be exchanged in its entirety. This separator is thus very advantageous from a hygiene aspect.

Exemplary embodiments of the invention are directed to a further improvement of the running characteristics and also of the ease of handling of the construction of a separator.

According to an aspect of the invention, the inflow device and the outflow device(s) are configured such that they extend into the drum, do not rotate with the drum during operation, and are connected to one another in a sealed manner, in particular are bonded together and/or welded together, at one or more points. The thus configured inflow and outflow system is easy to produce and, since it does not rotate during operation, can be sealed off from the rotating drum relatively easily and at only one or very few points. It is in particular advantageously suitable for a separator in which the drum consists of plastic or a plastics composite.

Moreover, the drum has an outer supporting apparatus and a drum—referred to as the inner drum—arranged within the supporting apparatus. In that way, the running behavior of the rotating system, in particular of the drum, is easily significantly improved, since the outer supporting apparatus stabilizes the system. Because this supporting apparatus lies radially on the outside relative to the drum wall delimiting the drum interior, the actual drum which delimits the centrifugal space is hereinafter referred to as the "inner drum".

Furthermore, a means for clarifying the product to be processed in the centrifugal field is expediently arranged in the inner drum—for instance a plate assembly consisting of conical plates—which means improves the clarification process or, analogously, a concentration process.

In addition, it is here structurally advantageous and simple if the inflow and outflow system has as the inflow device an inflow tube, the center axis of which, in the fitted state, is aligned with the rotational axis of the drum, and/or that the inflow and outflow system has as the outflow device one or two or more gripper(s), which has/respectively have a disk portion and a shank portion.

Preferably, the inflow and outflow system has a single inflow device and two outflow devices, in particular in order to concentrate a product to be processed by separating from this a light phase.

In design terms, it is advantageous and simple if the grippers are made up of gripper components respectively consisting of a tube section and an annular disk portion. This can in turn be easily realized by virtue of the fact that the gripper components respectively consist of plastic or plastics composite, and that they are preferably respectively configured in one piece. In the assembly operation, the drum parts and the individual elements of the inflow and outflow system are preferably successively placed in suitable sequence, from bottom to top, axially one above the other, and drum parts, on the one hand, and the individual elements of the inflow and outflow system for the drum, on the other hand, are hereupon welded together and/or bonded together at suitable points. Thus, the separating disk, for instance, can only be fitted once the plate assembly and the supporting body are installed, and the inflow tube with the lower gripper. Next the gripper components of the second gripper are fitted, and only then is the inner drum top part mounted. The seal is then placed on this. Finally, the cover is fitted hereon. Exemplary suitable welding points are indicated in FIG. 1*b* by emboldened dots. The term "gripper" is synonymous with the term "skimmer disk" and with the term "centripetal pump device".

Preferably, a cover is further constructively placed over the gripper components, in a simple manner, the cover is configured as a multistepped, peripherally closed tube of cylindrical diameter, wherein the steps respectively axially delimit tube sections of different diameter, and wherein the cover delimits evacuation chambers.

It is further advantageous if extending radially outward from the cover is an annular disk portion, which bears in a flange-like manner against the housing and can preferably be detachably fastened thereto.

Preferably, between the annular disk portion of the drum top part, in particular an inner drum top part, and the annular disk portion of the cover is further provided at least one (preferably just a single) axially acting ring seal device. The seal between the inflow and outflow system and the drum can therefore be reduced to just a single region, which is cost-effective. Moreover, any heat development in the region of parts that slide one against the other, in the area of the preferably single seal between these parts, is minimized.

Moreover, it is advantageous if a separating plate is arranged or configured above the separating plate assembly, the separating plate is preferably provided with ribs on the top side, so that between the bottom side of the inner drum top part and the top side of the separating plate is formed at least one channel-like gap as the outflow channel.

According to one variant, the outer supporting apparatus is configured as an outer ring, which axially partially surrounds the inner drum. Such a ring in the style of a "bandage" stabilizes the construction on the outer periphery. The at least one stabilizing ring (or the plurality of rings) preferredly consists of metal, but can also be produced from a plastic or a plastics composite. It is also conceivable to provide a contour, for instance a ring-like pocket which is open axially in one direction, on the outer periphery of the inner drum, into which pocket the stabilization ring is inserted.

Furthermore, according to a preferred embodiment, it is advantageous if the outer supporting apparatus is configured as a peripherally closed outer ring, which axially partially surrounds the inner drum. However, it is also conceivable that the outer supporting apparatus is configured as a latticed outer ring, which surrounds the inner drum on a specific axial portion.

According to another variant, the outer supporting apparatus is configured as an outer drum, which wholly or partially surrounds the inner drum. Particularly in this manner, the running behavior of the rotating system, in particular of the drum, is easily significantly improved, since the outer drum stabilizes the system dynamically and mechanically. Both deflections of the rotating system in the radial direction to the rotational axis D and the tendency toward imbalance can be markedly reduced. Both the inner drum and the supporting structure can—but do not have to be—designed such that they are relatively thin-walled. In particular, the inner drum, which is preferably to be changed following processing of a product batch, can hereby be produced in a very material-saving manner.

It nevertheless remains possible to utilize the advantages of the "plastics" or "plastics composite" material, for it is still possible to design a part of the drum—the inner drum and preferably the constituent parts thereof—in particular together with the inflow and outflow systems or regions—for single use, so that, following operation for processing of an appropriate product batch in the, during the processing of the product batch, preferably continuous and sanitary operation, no cleaning of the drum has to be performed, but rather the drum is exchanged in its entirety. This exchange therefore turns out to be particularly simple, since the outer drum, which is preferably reused, requires no great cleaning, as it preferably does not make any contact with product to be processed. It therefore does not have to be cleaned and/or disinfected with each change of the inner drum, or only relatively briefly.

The changing of the inner drum, and the assembly, disassembly and other handling thereof, can be easily performed, for, since a stable outer drum construction, into which the inner drum has only to be inserted, is present, it is possible to provide the drive connection to an electric motor only on the outer drum, so that, when a change is made, the inner drum has only to be removed from the outer drum and another inner drum inserted back into this, without a large number of complicated assembly steps, such as the establishment of a drive connection to the drive shaft, being necessary for this purpose.

The outer drum can here fully surround the inner drum. However, a good stabilization of the rotating system is also already obtained if the outer drum axially only partially surrounds the inner drum, preferably over in any case 50% of the axial length of the inner drum or more. In the latter case, it is advantageous if the inner drum protrudes axially from the outer drum, which makes it easier to separate and to distance the inflow and outflow region of the inner drum clearly from the outer drum.

It is particularly advantageous if the inner drum and the outer drum consist of different materials, because, in that way, the optimal materials can respectively be chosen for both elements—outer drum and inner drum. Preferredly, the inner drum consists of a, once again, preferably relative thin-walled plastic or a plastics composite, so that it can easily be disposed of, and the reusable outer drum consists of metal, in particular of steel, so that its running characteristics can be optimized particularly well.

An added advantage in this is that, where a metallic outer drum and a plastics inner drum are used, the weight of the outer drum can significantly exceed that of the inner drum, so that the rotation behavior is substantially determined by the outer drum. In addition, the weight of the rotating parts of the metallic outer drum is more than twice as large, in particular more than four times as large, as the weight of the rotating plastics parts, or than the weight of the empty inner drum. As a result of the outer drum, it is also possible to shape the inner drum in a particularly thin-walled design, since it is stabilized by the outer drum.

In order to be able to insert the inner drum nicely and easily into the outer drum, it is advantageous if the outer drum has an outer drum bottom part, and an outer drum top part detachable therefrom. By contrast, it is advantageous, essentially for production reasons, if the inner drum has an inner drum bottom part, and an inner drum top part that is preassemblable or preassembled herewith. For it is necessary to place in the inner drum, in the course of the production, various elements, such as the clarifying means, an inflow tube and the like, which is made easier by the separation into top part and bottom part.

The fitting of the inner drum into the outer drum is particularly simple if the outer drum top part is configured in the style of a ring, which is screwed to the outer drum bottom part and which is configured open in the axially upward direction, so that the inner drum top part protrudes axially therefrom. The outer drum bottom part and the outer drum top part can also be connected differently. One advantageous variant is a connection with screw bolts. A bayonet is also conceivable as the connecting means. Finally, it is advantageous to connect the outer drum top part and the outer drum bottom part one to the other, or fix them relative to one another, with a locking ring. To this end, a lower rim of the outer drum top part is inserted into the outer drum bottom part, where it can rest on a collar. Next a ring with external thread is screwed from above into an internal thread of the outer drum bottom part, which ring fixes the outer drum top part on the outer drum bottom part.

In order to realize a reliable rotation, as far as possible without slippage between the inner drum and the outer drum, it is advantageous if the inner drum and the outer drum are non-positively and/or positively connected to one another in a rotationally secure manner.

For reasons of hygiene, it is further advantageous if the inflow and outflow system of the drum are arranged solely on the inner drum and on the housing, so that the outer drum does not, during operation, come into contact with the product to be processed.

All in all, including with the concept of the inner drum, some of the, and preferably even all of the product-touching regions of the rotating system consist of a plastic or a plastics composite, in particular the inner drum bottom part and inner drum top part and the plate assembly. Particularly preferredly, the inflow system and outflow system also consist of a plastic or a plastics composite.

It is particularly advantageous if all parts of the inner drum that rotate during operation, and the parts of its inflow and outflow system which do not rotate during operation—insofar as they come into contact with product—consist of plastic, and if all in all—except for any seals which might have to be provided—also only a small number of parts, for example plastics injection molded parts, are provided. Preferably these are the inner drum bottom part, the inner drum top part, the distributor, the separating means (preferably the plate insert for the separation of solids), a separating plate and the inflow and outflow system comprising the grippers and the inflow tube, which do not rotate.

In addition, there can be one or more extra sealing rings. In this way, there is created a functional, plastics centrifugal drum, consisting only of very few constituent parts, which makes their production and their assembly particularly simple.

In addition, it is here particularly advantageous if the inner drum bottom part and the inner drum top part are non-detachably connected to one another during the initial assembly in order to prevent any attempt to disassemble them and possibly reuse them after insufficient cleaning. Instead, the inner drum is fully disposed of and recycled. This has the added advantage that sterility is ensured. The design is preferably such that, prior to installation and following removal, no air can penetrate into the inner drum from outside.

With the concept of the inner drum, it is still possible, as in PCT International patent document WO 2014/000829 A1, to design a part of the drum, or preferably even the entire drum—preferably along with the inflow and outflow systems and regions—for single use, which is of interest and advantage in particular with regard to the processing of pharmaceutical products such as fermentation broths or the like, because, following operation for the processing of an appropriate product batch in the, during processing of the product batch, preferably continuous operation, no cleaning of the drum has to be performed, but rather the drum is exchanged in its entirety. Hygiene problems associated with a cleaning are hereby easily precluded. The product-touching parts can be wholly disposed of or recycled. Disposal is in particular also of interest in the case of hazardous substances. In turn, it is also conceivable, in a product clarification process, to primarily carry out a concentration of a product to be processed and to melt down the inner drum after the processing of a batch or, for instance, to dissolve it in an acid or the like in order to extract the heavy material as a residue of this process. Through the use of preferably thin-walled plastics parts, the production costs, moreover, can be kept relatively low.

It is here advantageous, as well as particularly hygienic, if the entire drum, in particular also its inflow and outflow system, is/are configured in sealed construction.

Preferably, a recyclable plastic, in particular PE (polyethylene), PP (polypropylene) or TK-PEEK (in particular partially crystalline) polyetheretherketone, is used as the plastic. Inter alia (and this is no definitive list), the materials PC (polycarbonate), MABS (methyl methacrylate acrylonitrile butadiene styrene), ABS (acrylonitrile butadiene styrene) and PSU (polysulfone), are also conceivable.

Those parts produced from plastic could be made in an injection molding process and, where appropriate, reworked, for example be provided with bores and the like where this is necessary.

Screws and the like can also consist of plastic, but they can also consist of a different material, in particular if they are not touched by the product in the course of the processing.

BRIEF DESCRIPTION OF THE DRAWING FIGURES

The invention is described in greater detail below on the basis of illustrative embodiments, with reference to the figures, in which:

FIG. 1 shows in a) a side view of a separator according to the invention with a direct drive, in b) a detailed and detail-enlarged representation of an inflow and outflow region of the separator drum from a), and in c) a detailed and detail-enlarged representation of an alternatively designed outer peripheral region of a separator drum in the style of FIG. 1 *a*).

DETAILED DESCRIPTION

Figure 1B:
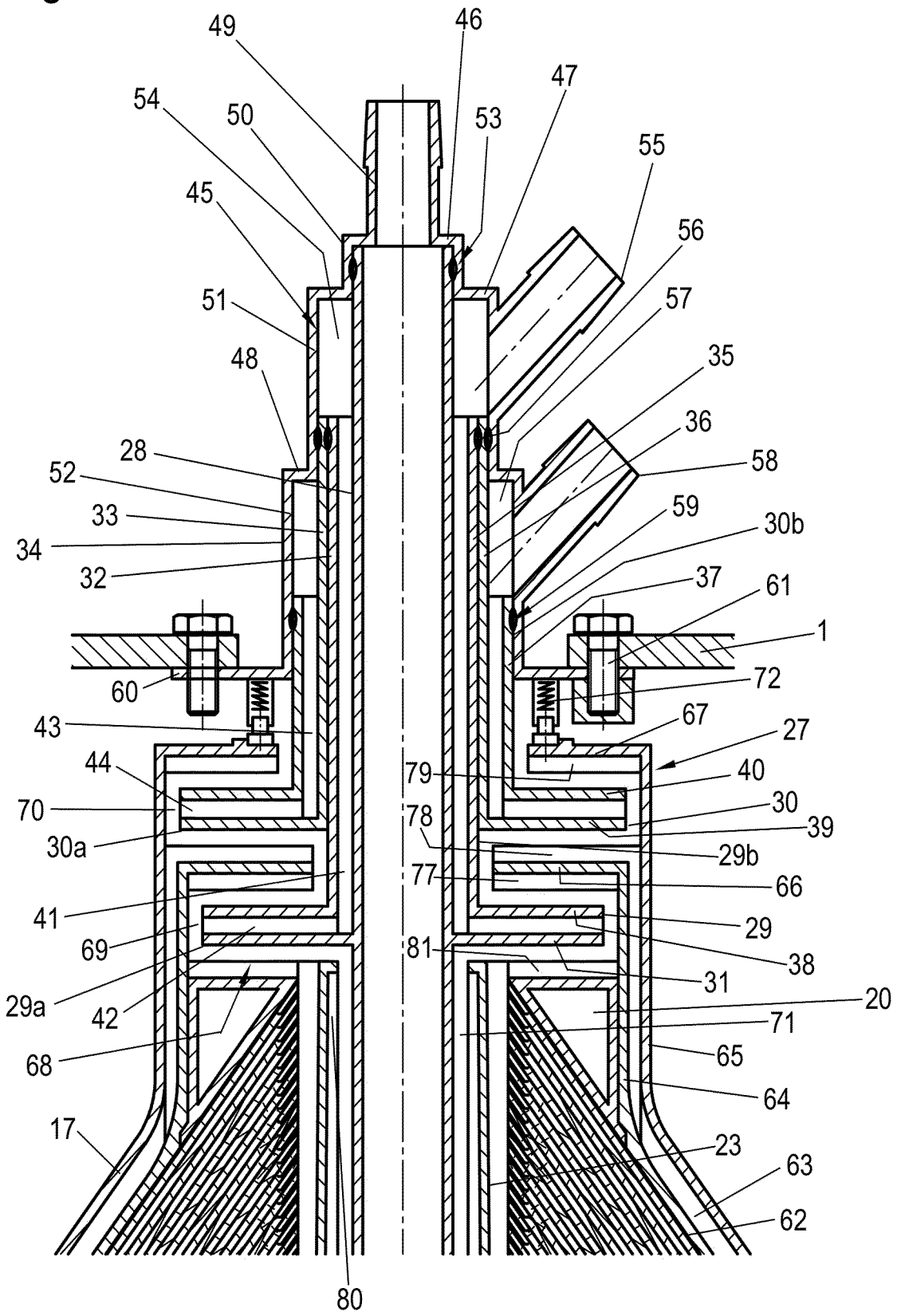

FIG. 1*a* shows a section through the region of a housing 1 and of a drum 2 of a separator according to the invention, with which a liquid product can in the centrifugal field be separated into two phases. The drum 2 has a vertical rotational axis D. Hereinafter used terms such as "(at the) top" or "(at the) bottom", "radial", etc. relate to the orientation of elements of the separator in relation to this vertical rotational axis.

The housing 1 has a bottom base 3, a housing casing 4 and a top cover 5. The base 3, in turn, has a bushing 6, which is passed through by a rotatable drive spindle 7. Preferably, directly beneath the base 3 is arranged a drive motor 8. This drive motor 8 serves to drive the drive spindle 7. Alternative embodiments are conceivable, for example of the kind in which the drive spindle 7 is driven with a drive belt or the like, in which case the drive motor is arranged elsewhere. However, a direct drive, in particular in the style of FIG. 1*a*, in which the drive shaft of the motor is arranged directly in vertical extension of the drive spindle 7, is preferred. A dedicated mounting of the spindle construction is here preferably dispensed with, which makes the construction easily and relatively cheaply realizable. This construction is simple and robust and very well suited to the light drum construction. The function of the mounting of the drum is assumed in a simple manner by the electric motor or its rotor bearing.

The drum 2 is in turn mounted onto the vertically upper end of the drive spindle 7 such that it is non-rotatable relative to the drive spindle 7, so that it can be set in rotation by the drive spindle 7 and the drive motor 8.

The drive spindle 7 could be mounted in the housing 1, in this case in the base 3, rotatably with one or more bearings. However, such a mounting can also be dispensed with. In this case, a gap 9 is formed between the outer periphery of the drive spindle and the inner periphery of the bushing 6 of the base 3. In that way, a mounting of a drive shaft 10 in the motor housing of the drive motor 8, on which mounting the drive spindle 7 is fixed or on which mounting it is otherwise configured, can also easily be used for the mounting of the whole rotating system, consisting of the drum 2 and the drive spindle 7. Thus, it is also preferred that the drive spindle 7 is directly coupled to the output shaft of the motor, and that the drive spindle 7 has no additional pivot bearing—for instance no collar bearing and no footstep bearing—on its outer periphery. Preferably, a spring system is also not provided for the resilient support in the region of the drive spindle.

The structure of the preferredly used drum 2 shall now be described in greater detail below.

The drum 2 has an outer drum 11, which can also be configured as an outer drum portion—and an inner drum 12. The inner drum 12 is inserted exchangeably in the outer drum 11.

Preferably, the outer drum portion or the outer drum 11 and the inner drum 12 consist of different materials. Particularly preferredly, the outer drum 11 consists of metal, in particular of steel, and the inner drum 12 preferably consists wholly, or at least partially, of a plastic or a plastics composite.

The outer drum 11 here serves as a type of mounting, in which the inner drum 12 is inserted and which at least in some sections surrounds or borders the inner drum 12 in the vertical or axial direction over the whole of its periphery. Particularly preferredly, the outer drum 11 and the inner drum 12 are connected to one another in a rotationally secure manner. This can be realized in particular by a positive and/or non-positive engagement between the outer drum 11 and the inner drum 12.

The outer drum 11 has an outer drum bottom part 13, which can be, or in this case is configured substantially like the drum bottom part of known separators having no inner drum. The outer drum bottom part 13 is mounted in a rotationally secure manner on the drive spindle 7 and preferably has on the inside a single-conical, or here particularly preferredly, double-conical inner shape. The outer drum 11 preferably further has an outer drum top part 14. Preferably, the outer drum bottom part 13 and the outer drum top part 14 have corresponding threads, in the region of which they are directly screwed together. The thread of the outer drum bottom part portion is configured as an internal thread of the drum bottom part, and the thread of the outer drum top part 14 as a corresponding external thread.

The outer drum top part 14 is likewise conically configured. It is further configured as a ring, which at the bottom is connected in a rotationally secure manner to the outer drum bottom part 13 and which is configured open in the axially upward direction, so that the inner drum 12 protrudes vertically or axially upward from the outer drum, in this case from the outer drum top part 14.

Because the outer drum bottom part 13 and the outer drum top part 14 preferably consist of metal, in particular steel, and at least the drum bottom part is configured, like that of a separator drum, without an inner drum 12, they can largely offer the quietness of running and stability and reliability of a known modern separator drum made of metal. Because the outer drum 11 partially or wholly surrounds the inner drum 12 on the outside, the outer drum stabilizes the inner drum. In particular, the outer drum 11 advantageously helps to optimize the running characteristics of the entire drum 2 during high-speed operation. Moreover, the wall thickness of the inner drum 12 can also be chosen very much thinner than that of a wholly plastics separator drum with no outer drum 11, as proposed in PCT International patent document WO 2014/000829 A1. It should be noted that a yet to be described inflow and outflow system, however, even in constructions By contrast, the inner drum 12 outwardly delimits the actual separating or centrifugal space 15 for the centrifugal processing of a flowable product. The inner drum 12 is designed, with respect to its shaping, such that it preferably bears, largely positively, directly against the inner periphery of the outer drum.

The inner drum 12 has an inner drum bottom part 16 and an inner drum top part 17. Preferably, the inner drum bottom part 16 and the inner drum top part 17 are respectively conically configured, so that a double-conical body is formed. The parts 16 and 17 consist of plastic or a plastics composite and are connected to one another in a liquid-tight manner, in particular in upper (inner drum bottom part 16) and lower (inner drum top part 17) flange regions 18, 19 (see FIG. 1*c*).

Preferably, an integral connection between the inner drum bottom part 16 and the inner drum top part 17 and, where appropriate, of further elements of the inner drum 12, is provided, which connection, within the meaning of this document, can be achieved by a fusion, for instance, but also by a bonding. This can clearly be seen, in particular, in FIG. 1*c*. Other types of connection are also conceivable, such as a bayonet, or screw, or snap or latching fastening between the elements to be connected, namely inner drum bottom part 16 and inner drum top part 17 (not represented here). These can respectively also supplement the integral connection.

A distributor 21 is configured or arranged on the inner drum bottom part, at the top—in the form of a separate part or in the form of a part integrally connected to the inner drum bottom part—which distributor coaxially surrounds the rotational axis D and forms a complete distributor for the passage of the material to be centrifuged into the inner drum interior or centrifugal space 15, and for the acceleration of the centrifuge material in the peripheral direction during rotations of the drum 2.

The distributor 21 has a lower conical portion 22 and an upper tube section 23, which is oriented concentrically to the rotational axis D and is upwardly open (FIGS. 1*a* and 1*b*). This tube section 23 opens out at the lower end into the one or more of the distributor channels 24, which are configured obliquely to the rotational axis and open out, on a radius preferably on the outside of a plate assembly 25, into the actual centrifugal space 15.

In the centrifugal space 15 are arranged separating means or clarifying means, such as, in particular, the aforementioned one-piece or preferably multipart plate assembly 25, which is configured as a stack of axially spaced separating plates 26, which have a conical basic shape and which are preferably mounted in a rotation-proof manner onto the distributor attachment 21. The separating means for the clarification could also be configured in different form, for instance as a ribbed body having radial or arcuate ribs. The separating plates 26 have same or different radii.

The distributor attachment or distributor 21 can also be configured in one piece with the clarifying means if this is configured as a plastic clarifying insert with clarifying chambers in the style of German patent document DE 10 2008 052 630 A1. A product fed into the inner drum interior or centrifugal space 15 is separated in the drum 2 into various, preferably two, product phases of different density.

Serving for the feed-in and evacuation of the various product phases from the drum 2 is an inflow and outflow system 27, comprising at least one inflow device and at least two outflow devices (see, in particular, FIG. 1*b*).

As the inflow device, the inflow and outflow system has a peripherally closed inflow tube 28 of preferably cylindrical cross section, the center axis of which, in the fitted state, is aligned with the rotational axis D of the drum.

As the at least two outflow devices, the inflow and outflow system further has at least one, or preferably two, grippers 29, 30—also referred to as skimmer disks. Neither the inflow tube 28 nor the two grippers 29, 30 rotate with the drum during operation. Rather, they remain stationary during operation. The inner drum top part 17 rotates about the inflow and outflow system 27 during operation.

The two grippers respectively have a disk portion 29*a*, 30*a* and a shank portion 29*b*, 30*b*. The shank portions 29*b*, 30*b* are configured concentrically to the inflow tube 28 and to one another.

The grippers 29, 30 are formed of a plurality of gripper components, which respectively consist of a tube section and an annular disk portion, wherein the annular disk portion respectively extends radially to the tube section. Preferably, the gripper components respectively consist of plastic or plastics composite. In addition, they are preferably respectively configured in one piece.

The innermost and first of the gripper components is formed of the inflow tube 28 and an annular disk attachment 31 extending radially to the inflow tube 28—in this case configured in an approximately axially central region of the inflow tube 28. A second, third and fourth of these gripper components—32, 33, 34—are likewise respectively formed of a tube section 35, 36, 37 and an annular disk attachment 38, 39, 40 extending radially to this tube section at the end of the tube section. Preferably and advantageously, the tube sections 35, 36, 37 here respectively have different internal diameters, so that the tube sections 35, 36, 37 can be slid axially one into the other.

The tube section 35 of the second gripper component 32 is larger than the external diameter of the inflow tube 28 over which it is concentrically slid, such that an outflow channel 41 is formed between the external diameter of the inflow tube 28 and the internal diameter of the tube section 35 of the second gripper component 32. Moreover, the annular disk attachment 38 of the second gripper component 32 is axially distanced from the first annular disk attachment 31 on the inflow tube 28 (together also corresponding to the first gripper component) such that these two annular disk attachments 31, 38 jointly form the disk portion 29*a* of the first gripper 29. In that way, in the disk portion 29*a* of the first gripper 29 is likewise formed at least one radial outflow channel 42, which opens out into the axial outflow channel 41. Webs on the annular disk attachments 31, 38 can delimit the channel 41.

The third and the fourth gripper component 33, 34 jointly form the second gripper.

In addition, the tube section 36 of the third gripper component 33 is preferably and advantageously larger than the external diameter of the tube section 35 of the second gripper component 32 over which it is concentrically slid, such that it bears directly against the external diameter of the tube section 35 of the second gripper component. Preferably, the second gripper component 32 and the third gripper component 33 are connected, in particular welded or bonded, to one another. This connection exists preferably at least at the ends of the tube sections 35, 36, so that a gap between the tube sections 35, 36 is sealingly closed. The annular disk attachment 39 of the third gripper component 33 is arranged axially offset from the annular disk attachment 38 of the second gripper component 32.

In order to form the second gripper 30, the tube section 37 of the fourth gripper component 34 is larger than the external diameter of the tube section 36 of the third gripper component 33 over which it is concentrically slid, such that an axial outflow channel 43 is formed between the external diameter of the tube section 36 of the third gripper component 36 and the internal diameter of the tube section 37 of the fourth gripper component 34. Moreover, the annular disk attachment 40 of the fourth gripper component 34 is axially distanced from the annular disk attachment 39 on the third gripper component 33 such that these two annular disk attachments 39, 40 jointly form the disk portion 30*a* of the second gripper 30. In that way, in the disk portion 30*a* of the second gripper 30 is likewise formed a radial outflow channel 44, which opens out into the axial outflow channel 43. Webs on the axial disk portions (in the axial direction) can delimit the at least one radial outflow channel 43.

A cover 45 is placed over the four gripper components. This is configured as a multistepped, peripherally closed tube of cylindrical diameter, wherein the steps 46, 47, 48 respectively axially delimit tube sections 49, 50, 51, 52 of different diameter.

The first tube section 46 here advantageously forms, in a simple manner, also a connecting branch (for a hose or the like). It lies vertically or axially above the inflow tube 28 and is aligned therewith. The first step 49 bears axially against the end of the inflow tube. The second tube section 50 overlaps the inflow tube 28 on the outside. The second tube section 50 and the inflow tube 28 are here connected, in particular welded or bonded, to one another (connecting region 53), so that a gap between the inflow tube 28 and the cover 45 is sealingly closed.

Beneath the connecting region 53 is formed the second step 47, which is downwardly adjoined by the third tube section 51, which delimits on the outside an evacuation chamber 54 for the first gripper 29, the inner periphery of which evacuation chamber is formed by the outer periphery of the feed tube 28. On the outer periphery of this evacuation chamber 54 is formed a connecting branch 55. A hose or the like for the evacuation (not represented here) can be attached to this.

The third tube section 51 of the cover 45 overlaps on the outside the tube section 36 of the third gripper component, or the first gripper 29. The third tube section 51 of the cover 45 and the first gripper 29 are connected, in particular welded or bonded, to one another (connecting region 56), so that a gap between these elements is sealingly closed.

Beneath the connecting region 56 is formed the third step 48, which is downwardly adjoined by the fourth tube section 52, which delimits on the outside an evacuation chamber 57 for the second gripper 30, the inner periphery of which evacuation chamber is formed by the portion 35. On the outer periphery of this evacuation chamber 57 is in turn formed a connecting branch 58. To this can be attached a hose or the like for the evacuation (not represented here).

The fourth tube section 52 of the cover 45 overlaps on the outside the tube section 37 of the fourth gripper component, or the second gripper 30. The fourth tube section 52 of the cover 45 and the second gripper 30 are here connected, in particular welded or bonded, to one another (connecting region 59), so that a gap between these elements is sealingly closed.

Extending radially outward from the fourth tube section 52 is an annular disk portion 60. This annular disk portion of the cover 45 bears beneath the housing 1 in a flange-like manner against this same. The housing 1 and the cover 45 are preferably detachably connected to one another in this region, for instance by means of one or more bolts 61. The cover 45 protrudes vertically upward through a central opening in a cover 5 of the housing 2.

The interplay between the inflow and outflow system 27, which does not rotate during operation, and the rotatable (inner) drum shall now be discussed in greater detail below.

A separating plate 62 is arranged above the parting plate assembly 25 (see also FIG. 1*b*), a gap 63 as the outflow channel is formed between the bottom side of the inner drum top part 17 and the top side of the separating plate 62. In addition, above the separating plate 62 lies a supporting body 20, here a supporting ring, to ensure for stabilizing the construction above the plate assembly and for ensuring a defined seat of the plate assembly.

A heavier liquid phase (or a still just evacuatable, in particular only just somewhat flowable solid phase) is evacuated from the region of the largest inner periphery of the drum interior, through the gap 63 or a channel in the gap between the inner drum top part 17 and the separating plate 62, out of the centrifugal space.

The separating plate 62 and the inner drum top part 17 pass at their axially upper ends into cylindrical portions 64, 65. At the vertically upper ends, annular disk portions 66, 67 respectively radially extend radially inward from these cylindrical portions 64, 65. The annular disk portion 66 of the cylindrical portion of the separating plate 62 extends radially between the disk portions 29*a*, 30*a* of the two grippers 29, 30. The annular disk portion 67 of the cylindrical portion 65 of the inner drum top part 17 extends radially above the disk portion 30*a* of the second gripper 30.

Beneath the first gripper 29, an annular disk contour 68 extends, likewise radially, inward in the manner of an annular disk. This can be configured as a radial attachment of the distributor 21, or differently, for example as an attachment of the separating disk. In that way gripper chambers 69, 70 are formed in the interplay of the cylindrical portions 64, 65 and the annular disk portions and contours 66, 67, 68. From the gap 63, the heavier phase flows through the gap between the two cylindrical portions and into the upper gripper chamber 70, where the second gripper 30 evacuates this phase.

A channel 71 on the inside of the separating plate assembly 25 further leads the lighter phase, flowing radially inward out of the separating plate assembly 25, into the first, lower gripper chamber, from which the first gripper 29 evacuates the lighter phase.

Ribs 77, 78 on the annular disk portion 66, as well as preferably ribs 79 on the annular disk portion 67 and preferably ribs 80 and ribs 81 on the distributor 21 and on the supporting body 20, ensure transportation of the appropriate product phases during operation of the centrifuge.

The inflow and outflow system is designed in an advantageous and structurally simple manner as a system which does not rotate with the inner drum during operation, i.e., the inner drum 12 rotates during operation relative to or about this inflow and outflow system 27. An axially acting ring seal device 72 is therefore preferably and advantageously provided between the annular disk portion 67 of the inner drum top part 17 and the annular disk portion 60 of the cover 45. This can be spring-preloaded and/or configured similar to a face seal. A slidingly sealed bearing contact of the mutually rotating elements "cover 45 of the inflow and outflow system 27" and (inner) "drum top part 17" is advantageous in order to seal in a sanitary manner the region between the inflow and outflow system 27, which is stationary during operation, and the rotating drum 2.

Figure 1C:
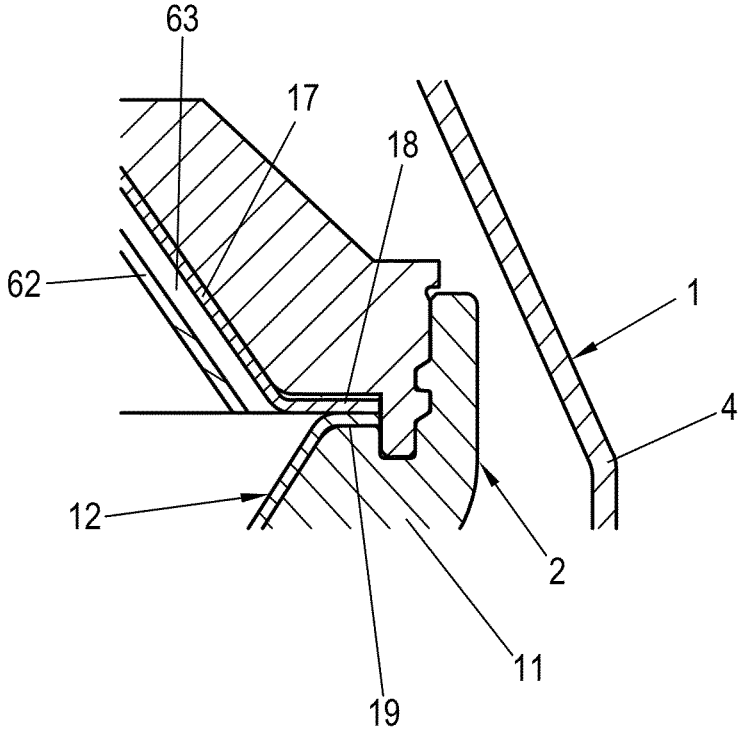

The inner drum 12 is positively and/or non-positively connected to the outer drum 11 in order easily to connect the inner drum and the outer drum 12, 11 one to the other in a rotationally secure yet detachable manner. In a simple manner, a non-positive connection can be realized by virtue of the fact that the flange regions 18 and 19, as well as, where appropriate, also an outer rim of the separating plate 62, extend into the screw connection region between the outer drum bottom part and the outer drum top part, where they respectively bear against steps of these parts and, when the drum top part is screwed in the drum bottom part, are clamped in a screw locking manner between these (FIG. 1*c*).

In addition, positive-locking means, such as ribs on the outer periphery of the inner drum and corresponding grooves on the inner periphery of the outer drum 11, can be provided, which positive-locking means mutually engage and in that way connect the two elements, inner drum 12 and outer drum 11, in a rotationally secure manner (not represented here). During operation, the inner drum 12 will come to lie, moreover, in a radially expanding manner, against the inner periphery of the outer drum 11, which improves the torque transmission and rotating transportation of the inner drum 12 by the driven outer drum 11. Alternatively, it would also be conceivable to connect the parts of the outer drum detachably to one another in a different manner, for instance with screw bolts or the like, or by means of a bayonet.

In that way, some, or preferably even all of the product-touching regions of the rotating system consist of plastic or plastics composite, in particular the inner drum bottom part 16 and the inner drum top part 17. Particularly preferredly, the separating plates 26 also consist of plastic, as well as all of the product-touching regions of the inflow and outflow system, also insofar as these do not rotate during operation.

Accordingly, the inner drum 12 can be disposed of after processing a sufficiently large product batch. By contrast, the preferably metallic outer drum 11 is reused. Because it cannot come into contact with product during operation, its cleaning is very simple or less important. By virtue of the outer drum 11, the inner drum 12 can be realized in very thin-walled construction. In the event of a complete disposal, very little plastics waste accordingly accrues.

FIG. 1 shows an embodiment as a two-phase separating machine (separation of a product into the phases: "liquid/liquid"), though three-phase machines (for separation into three phases) are likewise feasible (not represented here). The product is preferably, but not necessarily, a concentrating fermentation broth.

In that way, preferably the entire inner drum, along with the inflow and outflow system, is preferably designed as an exchangeable preassembled module made of plastic or a plastics composite.

The outer drum portion 11 here serves substantially as a mounting for the inner drum 12, which outer drum portion improves in particular the running characteristics of the inner drum 12.

The design of the outer drum top part as a ring is optimized in tests. It can be determined into which conical region, in the upward direction, the annular outer drum cap or the outer drum top part must surround the inner drum top part.

The structure of the housing 1 shall be considered once again in greater detail below. The housing 1 has the base 3, an in this case conical housing casing 4, and the cover 5. Only in the region of the cover 45 of the inflow and outflow system 27 does the housing 1 come into contact with the plastics region that is disposable after one operation. The cover is suitably fastened—preferably with bolts 75—to the housing casing 4 (FIG. 1*b*). The housing casing 4 is further fastened—preferably with bolts 76—to the base 3 (FIG. 1*b*). These bolts 75, 76 (or other suitable connecting means) are arranged releasably in order to be able to easily change the inner drum 12.

In order to change the inner drum 12, the housing 1 is opened (bolts 75, 76) and the bolts 61 for the cover 45 of the inflow and outflow system 27 are released. Then the inner drum 12 is exchanged and, where appropriate, disposed of. The cover 5 is here intended to have preferably a central opening of such a size that it can be placed from above over the cover 45 of the inflow and outflow system with its feed and evacuation branches and, where appropriate, hoses which are attached thereto and which, following fitting, have merely still to be connected up to external connections. In that way, the fitting of the inner drum following the removal of the outer drum top part can be realized in a particularly simple and rapid manner. The hoses can be sealed, for instance welded, at the ends, and are cut off upon initial start-up and resealed following initial start-up. This can also be realized with clamps.

Preferably, the entire inner drum 12 is sanitary in design.

The housing 1 can be used to rest against a foundation or a stand 74 or a type of table or cabinet.

It is advantageous that the housing 1 has an outflow opening 73, preferably in its base 3, through which, where appropriate, liquid—which appears in the housing, for instance due to an unforeseen leakage, or which would collect there for some other reason, can flow off. To this end, at a connection of the opening 59 can be arranged an evacuation line, such as an outflow hose, for the evacuation of this liquid into a container.

A particularly compact construction is achieved by virtue of the fact that—as already discussed in the introduction—the drive motor is preferably an electric motor, which is arranged directly in axial extension of the drive spindle 7, preferably on the side facing away from the drum. Preferably, the drive spindle 7 is connected directly with a bolt to the output shaft 10. It is further connected in a rotationally secure manner with a torque transmission means, preferably a feather key, in the peripheral direction, to the output shaft of the electric motor (not represented here). The torque transmission means can also be configured in a different form—for instance as a torque transmission contour (in each case not represented here). A terminal box 75 is arranged on the motor 8.

The rotatable drum 2 can be connected to the drive spindle construction with a press fit (for example in a conical portion), or by means of some other torque transmission means (not represented here). The motor 8 is, on its side facing toward the spindle 7, further fastened with a flange portion to the base of the housing 1, for instance with screw bolts. On the motor 8 is further arranged a terminal box.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SYMBOLS

Housing 1
Drum 2
Base 3
housing casing 4
cover 5
bushing 6
drive spindle 7
drive motor 8
gap 9
drive shaft 10
outer drum 11
inner drum 12
outer drum bottom part 13
outer drum top part 14
centrifugal space 15
inner drum bottom part 16
inner drum top part 17
flange regions 18,19
supporting body 20
distributor 21
conical portion 22
tube section 23
distributor channels 24
plate assembly 25
separating disk 26
inflow and outflow unit 27
inflow tube 28
grippers 29,30
disk portion 29*a*,30*a*
shank portion 29*b*,30*b*
first annular disk attachment 31
gripper components 32,33,34
tube section 35,36,37
annular disk attachment 38,39,40
outflow channels 41,42,43,44
cover 45
steps 46,47,48
tube sections 49,50,51,52
connecting region 53
evacuation chamber 54
connecting branch 55
connecting region 56
evacuation chamber 57
connecting branch 58
connecting region 59
annular disk portion 60
bolt 61
separating plate 62
gap 63
cylindrical portions 64,65
annular disk portions 66,67
annular disk contour 68
gripper chambers 69,70
channel 71
ring seal device 72
outflow opening 73
stand 74
bolts 75,76
ribs 77,78,79,80,81
vertical rotational axis D

The invention claimed is:

1. A separator for centrifugally processing a flowable product, comprising:

a rotatable drum delimiting a centrifugal space, wherein the rotatable drum has an inflow and outflow system comprising at least one inflow device and one or more outflow devices, which consist of plastic or a plastics composite, wherein the rotatable drum has an outer drum and an inner drum arranged in the outer drum, wherein the inner drum consists of plastic or a plastics composite, wherein the outer drum has an outer drum bottom part and an outer drum top part, wherein the outer drum only partially surrounds the inner drum and the inner drum protrudes axially from the outer drum, wherein a means for clarifying the product to be processed in the centrifugal field is arranged in the inner drum, wherein a separating plate is arranged inside of the inner drum and between an inside of the inner drum and the clarifying means, wherein the inflow device and the one or more outflow devices extend into the inner drum, are configured such that the inflow device and the one or more outflow devices do not rotate with the inner drum during operation, and are connected, bonded and/or welded to one another in a sealed manner at one or more points, wherein the inflow and outflow system has as the outflow device one or more grippers, which respectively has/have a disk portion and a shank portion.

2. The separator of claim 1, wherein the inflow and outflow system of the inflow device has an inflow tube having a center axis that, in a fitted state, is aligned with a rotational axis D of the rotatable drum.

3. The separator of claim 1, wherein the one or more grippers are comprised of gripper components, which respectively consist of the disk portion and the shank portion, wherein the shank portion is a tube section and the disk portion is an annular disk portion.

4. The separator of claim 3, wherein the gripper components respectively consist of plastic or plastics composite and are respectively configured in one piece.

5. The separator of claim 3, wherein the one or more grippers comprises at least two grippers, each having the tube section, wherein the tube sections of the at least two grippers have different diameters, wherein over the gripper components are placed a cover, wherein the cover is a multi-stepped, peripherally closed tube of cylindrical diameter, and wherein steps of the multi-steps respectively axially delimit the tube sections of the at least two grippers.

6. The separator of claim 5, wherein a first one of the at least two grippers is coupled to an evacuation chamber and the cover delimits the evacuation chamber at least radially on an outside.

7. The separator of claim 5, wherein the cover includes an annular disk portion that radially extends outward from the cover, wherein the annular disk portion of the cover bears in a flange-like manner against a housing and is detachably fastened to the housing.

8. The separator of claim 5, wherein the clarifying means is a separating plate assembly and the separating plate is arranged or configured above the separating plate assembly so that at least one gap is formed as an outflow channel between a bottom side of a top part of the inner drum top and a top side of the separating plate.

9. The separator of claim 8, wherein the separating plate and the top part of the inner drum pass at their axially upper ends into cylindrical portions, wherein at vertically upper ends extend inward from the cylindrical portions to delimit gripper chambers.

10. The separator of claim 8, wherein at least one axially acting ring seal device is provided between an annular disk portion of the top part of the inner drum and an annular disk portion of the cover.

11. The separator of claim 1, wherein the outer drum, at a point where the outer drum surrounds the inner drum, is peripherally closed.

12. The separator of claim 11, wherein the outer drum fully surrounds the inner drum in a peripheral direction.

13. The separator of claim 1, wherein the inner drum and the outer drum consist of different materials.

14. The separator of claim 13, wherein the outer drum consists of steel.

15. The separator of claim 1, wherein the outer drum bottom part and the outer drum top part are fixed to one another by screwing means.

16. The separator of claim 1, wherein the outer drum bottom part and the outer drum top part are fixed to one another by:

screw bolts, a locking ring, or a thread between the outer drum top part and the outer drum bottom part.

17. The separator of claim 1, wherein the inner drum has an inner drum bottom part and an inner drum top part.

18. The separator of claim 17, wherein the inner drum bottom part and the inner drum top part are non-detachably connected to one another.

19. The separator of claim 17, wherein the inner drum bottom part and the inner drum top part are bonded or welded to one another.

20. The separator of claim 17, wherein the inner drum bottom part and the inner drum top part are mechanically connected to one another.

21. The separator of claim 17, wherein the outer drum top part is a ring that is open in an axially inward direction so that the inner drum top part protrudes axially from the outer drum top part.

22. The separator of claim 1, wherein the inner drum and the outer drum are non-positively and/or positively connected to one another in a rotationally secure manner.

23. The separator of claim 1, wherein the outer drum is driven by a drive motor.

24. The separator of claim 1, wherein the clarifying means is a plate assembly consisting of a stack of separating plates produced from plastic or a plastics composite.

25. The separator of claim 1, wherein the outer drum top part, the inner drum top part, the outer drum bottom part, and the inner drum bottom part are conical.

26. The separator of claim 1, wherein the outer drum bottom part is connected in a rotationally secure manner to a drive spindle.

27. The separator of claim 1, wherein the inflow and outflow system of the drum is configured solely on the inner drum.

28. The separator of claim 1, wherein an inner wall of the inner drum does not have any solids discharge openings leading radially out of the inner drum into a space surrounding the inner drum.

29. The separator of claim 1, wherein all regions of the rotatable drum that come into contact with product during operation consist of plastic or a plastics composite.

30. The separator of claim 1, wherein an entirety of the inner drum, as well as the inflow and outflow system, are an exchangeable preassembled module made of plastic or a plastics composite.

31. The separator of claim 1, wherein the rotatable drum is arranged in a housing.

32. The separator of claim 31, further comprising:

a drive motor directly flange-connected to the housing.

33. The separator of claim 1, further comprising:

an outflow channel arranged between the inner drum and the separating plate, wherein the outflow channel fluidically couples the centrifugal space with an outlet of the separator.

34. The separator of claim 1, wherein the outer drum is metallic.

35. The separator of claim 34, wherein the outer drum consists of metal.

* * * * *